US008083088B1

(12) United States Patent
Thompson et al.

(10) Patent No.: US 8,083,088 B1
(45) Date of Patent: Dec. 27, 2011

(54) TRASH PAIL LID LOCK APPARATUS AND METHOD OF USE

(76) Inventors: Joseph H. Thompson, Colorado Springs, CO (US); Sheldon L. White, Tempe, AZ (US)

( * ) Notice: Subject to any disclaimer, the term of this patent is extended or adjusted under 35 U.S.C. 154(b) by 0 days.

(21) Appl. No.: 12/910,942

(22) Filed: Oct. 25, 2010

(51) Int. Cl.
*B65D 45/16* (2006.01)

(52) U.S. Cl. ..... 220/326; 292/258

(58) Field of Classification Search ..... 220/315, 220/324, 326; 292/253, 258
See application file for complete search history.

(56) References Cited

U.S. PATENT DOCUMENTS 2,805,788 A * 9/1957 Allbright et al. ..... 220/324
3,291,515 A * 12/1966 Lierman ..... 292/288
3,363,924 A * 1/1968 Remig ..... 292/258
3,893,725 A * 7/1975 Coulter et al. ..... 292/258
4,202,574 A * 5/1980 Redmayne ..... 292/228
7,178,840 B1 * 2/2007 Veach ..... 292/256.5

* cited by examiner

*Primary Examiner* — Harry Grosso
(74) *Attorney, Agent, or Firm* — G. F. Gallinger

(57) ABSTRACT

A trash pail lid lock apparatus for removably securing a trash pail lid on a trash pail, comprising: a) two spaced radial arms, having inner end portions attached together, and peripheral end portions generally extending to a peripheral edge portion of the trash pail lid; b) a sleeve member having a lateral side portion attached to the peripheral end portion of the radial arm, and having a sleeve portion thereof oriented so that an axis therethrough is upright; c) an upright J shaped member having an upright portion slidably, rotatably, and closely positioned within the sleeve portion of the sleeve member, said lower end portion of the J shaped member having an upwardly extending unattached end portion adapted to be received between a peripheral upright wall and lip of the trash pail; and, d) a spring to maintain the J shaped member in a lifted engagement position.

11 Claims, 1 Drawing Sheet

TRASH PAIL LID LOCK APPARATUS AND METHOD OF USE

FIELD OF THE INVENTION

This invention relates to apparatuses and methods used to prevent animals from accessing trash placed in containers prior to the removal of those containers. More particularly this invention relates to an apparatus used to secure the lid on a trash pail so securely that even a bear is unable to break open the trash pail.

BACKGROUND OF THE INVENTION

Garbage, and particularly garbage containing smelly and rotting food are of particular interest to animals. They are guided from afar by the smell to an easy meal. Home owners particularly on the outskirts of metropolitan areas, surrounded by undeveloped land must cope with wild animals raiding their loaded trash pails prior to pick up. Such wild animals include racoons, porcupines, coyotes, wolves, and even bears. Bears are particularly problematic in as much as they have great strength to access, knock over, and assault a trash pail. Most enclosures which surround or cover trash pails also can be quickly broken down by a bear. Once the trash is accessed, it is generally strewn over a considerable area. In addition to the time consuming and unsavory chore of picking up the pieces of trash, there also is the problem that the animal has learnt where to return to find another easy meal. Home owners living in suburban areas also have problems with domesticated dogs turning over there trash pails and strewing about the trash therein. Although these dogs are well fed, they cannot resist investigating the interesting odors.

The most efficient, convenient, and inexpensive solution to the problem of animals accessing garbage in trash pails is to provide a lid lock apparatus which is can be quickly and conveniently placed on, and removed from a trash pail. The apparatus should be adequately attached to the trash pail, and sufficiently rugged, so that even a bear is unable to tear the apparatus off the trash pail or beat up the trash pail sufficiently to access the garbage therein. Additionally the apparatus should be readily adapted fit onto different standard trash pail designs and sizes. It is also useful to have the apparatus provide structural support to prevent the top opening of the trash pail being squeezed to pop the trash pail lid. Finally, the apparatus should be available with different levels of protective abilities. A device which is capable of withstanding the assault of a bear is an overkill in neighborhoods where the largest predator is a domesticated dog.

OBJECTS OF THE INVENTION

It is an object of this invention to disclose a trash pail lid lock which can be quickly and conveniently placed on and attached to a trash pail securing the lid thereon. It is an object of this invention to disclose a trash pail lid lock apparatus which peripherally attaches the trash pail lid in a fully closed position on the top opening of the trash pail, thereby peripherally maintaining the lid in a fully closed position. Its yet a further object of this invention to disclose a lid lock apparatus which reinforces a top opening of a trash pail against lateral load thereby preventing lateral bending of the pail at the top opening, and popping of the lid under severe assault. It is yet a further object of this invention to disclose a design for a trash pail lid lock which not only can be fortified by construction with heavier materials, but additionally by construction having an increased number of peripheral attachments. It is a final object of this invention to disclose a trash pail lid lock apparatus which can be constructed from inexpensive plastic pipe and fittings.

One aspect of this invention provides for a trash pail lid lock apparatus for removably securing a trash pail lid on a trash pail, having an upright peripheral wall having a top portion terminating in a rounded lip extending outwardly and down from a top portion of the peripheral wall of the trash pail, comprises: a) two spaced radial arms, having inner end portions attached together, and peripheral end portions generally extending to a peripheral edge portion of the trash pail lid; b) a sleeve member having a lateral side portion attached to the peripheral end portion of the radial arm, and having a sleeve portion thereof oriented so that an axis therethrough is upright; c) an upright J shaped member having an upright portion slidably, rotatably, and closely positioned within the sleeve portion of the sleeve member, said lower end portion of the J shaped member having an upwardly extending unattached end portion adapted to be received between an outside of the upright wall and the bent over and down lip; and, d) a spring to maintain the J shaped member in a lifted position wherein the unattached end portion of the J shaped member is maintained in engagement beneath the rounded lip of the trash pail.

Most generally a method of securing a trash pail lid on a trash pail comprises the following steps: a) obtaining a trash pail lid lock apparatus as described above; b) seating the radial arms on a top portion of the trash pail lid by rotating the upright J shaped members outwardly thereby allowing the lower end portions of the J shaped members to receive the top portion of the trash can pail therebetween; c) pushing down the J shaped members and ensuring the unattached lower end portion of the J shaped member is positioned between the peripheral wall of the pail and the rounded peripheral lip thereof; and finally, d) releasing downward pressure on the j shaped members so that the J shaped members are maintained in an engaged position.

Various other objects, advantages and features of this invention will become apparent to those skilled in the art from the following description in conjunction with the accompanying drawings.

FIGURES OF THE INVENTION

Figure 1:
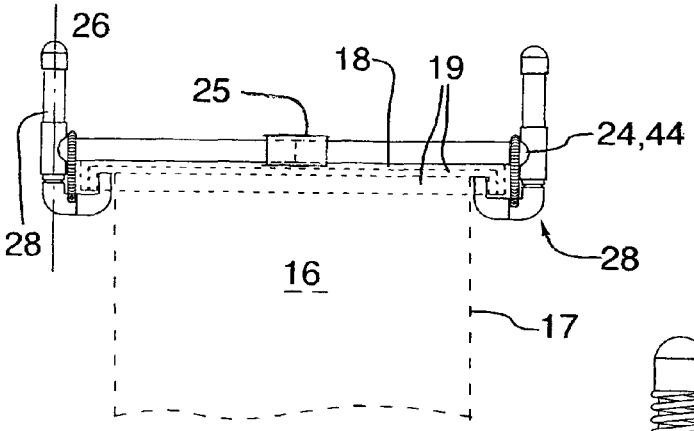
FIG. 1 is an elevational view of a trash pail lid lock apparatus locking a trash pail lid on a trash pail.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
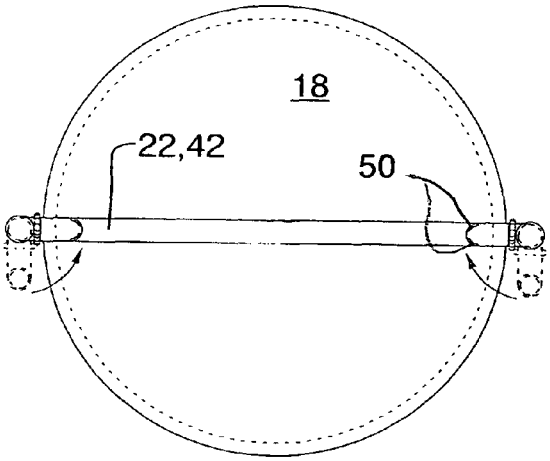
FIG. 2 is a plan view of trash pail lid lock apparatus and the trash pail shown in FIG. 1, but wherein the two joined radial arms comprise a single arm. The J shaped member is shown in ghost in a rotated position suitable for positioning the apparatus over and onto the lid of the closed trash pail.

Turning now to the drawings and more particularly to FIG. 1 we have an elevational view of a trash pail lid lock apparatus 20 for locking a trash pail lid 18 on a trash pail 16. FIG. 2 is a plan view of trash pail lid lock apparatus 20 and the trash pail lid 18 shown in FIG. 1. The J shaped member 28 is shown in ghost in a rotated position suitable for positioning the apparatus over and onto the lid of the closed trash pail 16. Most generally, a trash pail lid lock apparatus 20 for removably securing a trash pail lid 18 on a trash pail 16, having an upright peripheral wall 17 having a top portion terminating in a rounded lip 19 extending outwardly and down from a top portion of the peripheral wall 17 of the trash pail 16, comprises: a) two spaced radial arms 22, having inner end portions attached together, and peripheral end portions generally extending to a peripheral edge portion of the trash pail 16; b) a sleeve member 24 having a lateral side portion attached to the peripheral end portion of the radial arm 22, and having a sleeve portion thereof oriented so that an axis 26 therethrough is upright; c) an upright J shaped member 28 having an upright portion slidably, rotatably, and closely positioned within the sleeve portion of the sleeve member 24, said lower end portion of the J shaped member 28 having an upwardly extending unattached end portion adapted to be received between an outside of the upright wall 17 and the bent over and down lip 19; and, d) an engagement maintenance means 30 to maintain the J shaped member in a lifted position wherein the unattached end portion of the J shaped member 28 is maintained in engagement beneath the rounded lip 19 of the trash pail 17.

Figure 3:
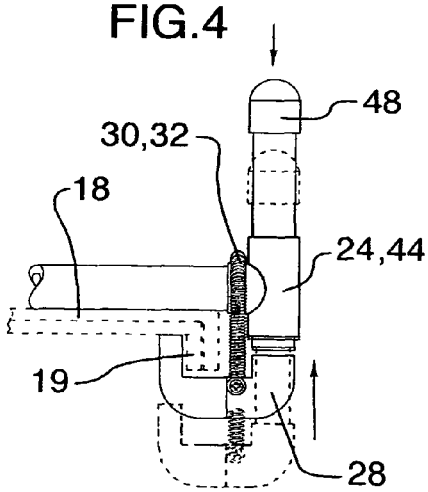
FIG. 3 is an enlarged perspective view of an end portion of a radial arm, attached to a sleeve member which slidably and rotatably contains a J shaped member.

FIG. 3 is an enlarged perspective view of an end portion of a radial arm 22, attached to a sleeve member 24 which slidably and rotatably contains a J shaped member 28. The J shaped member 28 is pushed downwardly relative to the sleeve member 24 so that it thereafter may be released under the lip 19 of the trash pail 16 in an engaged locking position. In the most preferred embodiment of the invention the engagement maintenance means 30 comprises a spring 32 upwardly biasing the J shaped member 28 within the sleeve member 24. Most preferably, the spring 32 has a lower end portion attached to a central lower portion of the J shaped member 28 and an upper end portion attached along a peripheral end portion of the radial arm 22 corresponding therewith, so that the spring 32 upwardly biases the J shaped member 28 relative to the sleeve member 24, and additionally generally maintains the J shaped member 28 in a position wherein the lower portion of the J is biased inwardly so that the J shaped member 28 must be consistently rotated outwardly to seat the radial arms 22 on a top portion of the trash pail lid 18, and thereafter the J shaped members 28 automatically rotate to an engagement position when released from a depressed position. If the upper end portion of the spring 32 extends up, over and around the radial arm 22 before attachment thereto, greater extension of the spring 32 without deformation is provided for.

In the most preferred embodiment of the invention the radial arms 22, the sleeve member 24, and the J shaped member 28, respectively comprise plastic pipe 42, a pipe tee 44, and pipe elbows 46 for rugged, inexpensive, and size adaption to varying trash pail 16 designs and sizes. A prototype apparatus has been constructed with 1½" PVC pipe. 1¼" PVC has been used for the J shaped members 28. With this pipe diameter the apparatus is adequate with just two radial arms 22 to withstand the assault of a bear. When only two radial arms 22 are utilized the radial 22 could be attached with a pipe coupling 25, or as shown in FIG. 1 the two radial arms 22 could comprise a pipe coupling 25. Alternatively, and more practically, where there are two, and only two radial arms 22, these two radial would comprise a single lateral arm or pipe 42 extending across a diameter of the trash pail 16. With the use of a pipe cross (not shown) positioned centrally between the two radial arms 22, four radial arms, each of smaller diameter could be employed. For aesthetic reasons the apparatus 20 may further comprise a pipe cap 48 positioned on and over the upper portion of the J shaped member 28. Within this specification plastic pipe is defined to include pipe sold as either "PVC" or "ABS". The lower unattached end portion of the J shaped member 28 comprises two spaced apart tabs 50 each having a radial width for close receipt and engagement between an upper portion of the trash pail peripheral wall 17 and the rounded lip 19. Use of two spaced apart tabs 50 better and more broadly distributes the force exerted on the lip 19 when the apparatus 20 is tested by an animal. It is noted that when diametrically opposite sides of the unattached end portion of the J shaped member 28 are filed entirely through a wall thickness, thereby removing opposite sides of the circular pipe wall, then two central wall segments remain. When the opposites sides of the unattached end portion are filed or otherwise removed, the file or blade is generally held parallel to its first cutting position on the other diametric side of the J shaped member. These two remaining central wall segments each have a radial width and are herein called tabs 50.

Figure 4:
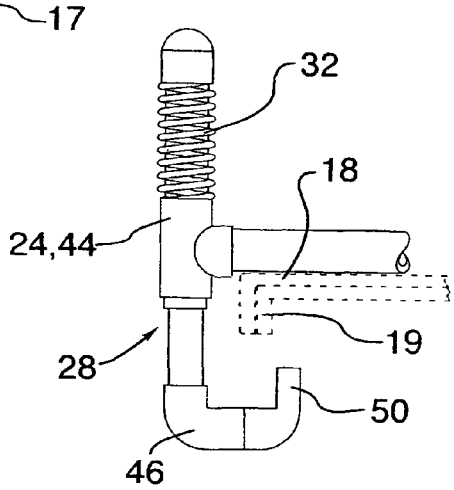
FIG. 4 is an enlarged perspective view of the end portion of the radial arm showing an alternative embodiment of the invention wherein the spring is positioned over a top portion of the J shaped member.

FIG. 4 is an enlarged perspective view of the end portion of the radial arm 22 showing an alternative embodiment of the invention wherein the spring 32 is positioned over a top portion of the J shaped member 28. The spring 32 is positioned over a top portion of the J shaped member 28 so that when the J shaped member is pushed downwardly, it compresses the spring 32, biasing the J shaped member 28 upwardly to an engaged locking position beneath the lip 19 of the trash pail 16.

Most generally a method of securing a trash pail lid 19 on a trash pail 16 comprises the following steps: a) obtaining a trash pail lid lock apparatus 20 as described above; b) seating the radial arms 22 on a top portion of the trash pail lid 18 by rotating the upright J shaped members 28 outwardly thereby allowing the lower end portions of the J shaped members 28 to receive the top portion of the trash can pail 17 therebetween; c) pushing down the J shaped members 28 and ensuring the unattached lower end portion of the J shaped member 28 is positioned between the peripheral wall 17 of the pail 16 and the rounded peripheral lip 19 thereof; and finally, d) releasing downward pressure on the J shaped members 28 so that the J shaped members 28 are maintained in an engaged position.

A method of sizing a trash pail lid lock apparatus 20 to a particular trash pail 16 for a specific level of security comprising the following steps: a) obtaining an unassembled trash pail lid lock apparatus 20 as described above; b) selecting the diameter of the plastic pipe 42 to match security needs; c) increasing the number of radial arms 22 to increase the number of spaced peripheral attachments if needed to increase the level of security; d) adjusting the length of the radial arms 22 to best accommodate a particular width of trash pail 16 and trash pail lid 18; e) sizing the tabs 50 on the unattached lower end portion of the J shaped member 28 for close receipt between the rounded lip 19 and the upright side walls 17 of the trash pail 16; f) assembling the radial arms 22, the sleeve members 24, the J shaped members 28 and attaching the spring 32; g) seating the radial arms 22 on a top portion of the trash pail lid 18 by rotating the upright J shaped members 28 outwardly thereby allowing the lower end portions of the J shaped members 28 to receive the trash pail 16 therebetween; h) pushing down the J shaped members 28 and ensuring the unattached lower end portion of the J shaped member 28 is positioned between the peripheral wall of the pail 17 and the rounded peripheral lip 19 thereof; and finally, i) releasing downward pressure on the J shaped members 28 so that the J shaped members 28 are maintained in an engaged position.

While the invention has been described with preferred specific embodiments thereof, it will be understood that this description is intended to illustrate and not to limit the scope of the invention, which is defined by the following claims.

We claim:

1. A trash pail lid lock apparatus for removably securing a trash pail lid on a trash pail, having an upright peripheral wall having a top portion terminating in a rounded lip extending outwardly and down from a top portion of the peripheral wall of the trash pail, comprising:

a) two spaced radial arms, having inner end portions attached together, and peripheral end portions generally extending to a peripheral edge portion of the trash pail lid;

b) a sleeve member having a lateral side portion attached to the peripheral end portion of the radial arm, and having a sleeve portion thereof oriented so that an axis therethrough is upright;

c) an upright J shaped member having an upright portion slidably, rotatably, and closely positioned within the sleeve portion of the sleeve member, said J shaped member having a lower end portion having an upwardly extending unattached end portion adapted to be received between an outside of the upright wall and the bent over and down lip; and, d) an engagement maintenance means to maintain the J shaped member in a lifted position wherein the unattached end portion of the J shaped member is maintained in engagement beneath the rounded lip of the trash pail.

2. A trash pail lid lock apparatus as in claim 1 wherein the engagement maintenance means comprises a spring upwardly biasing the J shaped member within the sleeve member.

3. A trash pail lid lock apparatus as in claim 2 wherein the spring has a lower end portion attached to a central lower portion of the J shaped member and an upper end portion attached along a peripheral end portion of the radial arm corresponding therewith, so that the spring upwardly biases the J shaped member relative to the sleeve member, and additionally generally maintains the J shaped member in a position wherein the lower portion of the J is biased inwardly so that the J shaped members must be consistently rotated outwardly to seat the radial arms on a top portion of the trash pail lid, and thereafter the J shaped members automatically rotate to an engagement position when released from a depressed position.

4. A trash pail lid lock apparatus as in claim 3 wherein the upper end portion of the spring extends up, over and around the radial arm before attachment thereto, to provide greater extension of the spring without deformation.

5. A trash pail lid lock apparatus as in claim 4 wherein the radial arms, the sleeve member, and the J shaped member, respectively comprise plastic pipe, a pipe tee, and pipe elbows for rugged, inexpensive, and size adaption to varying trash pail designs and sizes.

6. A trash pail lid lock apparatus as in claim 5 further comprising a pipe cap positioned on and over the upper portion of the J shaped member for aesthetic reasons.

7. A trash pail lid lock apparatus as in claim 6 wherein the lower unattached end portion of the J shaped member comprises two spaced apart tabs each having a radial width for close receipt and engagement between an upper portion of the trash pail peripheral wall and the rounded lip.

8. A trash pail lid lock apparatus as in claim 2 wherein the spring is positioned over a top portion of the J shaped so that when the J shaped member is pushed downwardly, it compresses the spring, biasing the J shaped member upwardly to an engaged locking position beneath the lip of the trash pail.

9. A method of securing a trash pail lid on a trash pail comprising the following steps:

a) obtaining a trash pail lid lock apparatus as described in claim 5;

b) seating the radial arms on a top portion of the trash pail lid by rotating the upright J shaped members outwardly thereby allowing the lower end portions of the J shaped members to receive the top portion of the trash can pail therebetween;

c) pushing down the J shaped members and ensuring the unattached lower end portion of the J shaped member is positioned between the peripheral wall of the pail and the rounded peripheral lip thereof; and finally, d) releasing downward pressure on the J shaped members so that the J shaped members are maintained in an engaged position.

10. A method of sizing a trash pail lid lock apparatus to a particular trash pail for a specific level of security comprising the following steps:

a) obtaining an unassembled trash pail lid lock apparatus as described in claim 7;

b) selecting the diameter of the plastic pipe to match security needs;

c) increasing the number of radial arms to increase the number of spaced peripheral attachments if needed to increase the level of security;

d) adjusting the radial width between the J shaped members to best accommodate a particular width of trash pail and trash pail lid;

e) sizing the tabs on the unattached lower end portion of the J shaped member for close receipt between the rounded lip and the upright side walls of the trash pail;

f) assembling the radial arms, the sleeve members, the J shaped members and attaching the spring;

g) seating the radial arms on a top portion of the trash pail lid by rotating the upright J shaped members outwardly thereby allowing the lower end portions of the J shaped members to receive the trash pail therebetween;

h) pushing down the J shaped members and ensuring the unattached lower end portion of the J shaped member is positioned between the peripheral wall of the pail and the rounded peripheral lip thereof; and finally, i) releasing downward pressure on the J shaped members so that the J shaped members are maintained in an engaged position.

11. A trash pail lid lock apparatus as in claim 1 wherein there are two, and only two radial arms, which comprise a single lateral arm extending across a diameter of the trash pail.

* * * * *